US006360561B2

(12) United States Patent
Allam et al.

(10) Patent No.: US 6,360,561 B2
(45) Date of Patent: Mar. 26, 2002

(54) APPARATUS AND METHOD OF HEATING PUMPED LIQUID OXYGEN

(75) Inventors: Rodney J. Allam, Guildford; Declan P. O'Connor, Chessington, both of (GB)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/798,111

(22) Filed: Mar. 2, 2001

(30) Foreign Application Priority Data

Mar. 6, 2000 (GB) ..... 0005374

(51) Int. Cl.[7] ..... F25J 3/00; F25J 5/00; F17C 9/02; F28F 3/00

(52) U.S. Cl. ..... 62/654; 62/50.2; 62/903; 165/166

(58) Field of Search ..... 62/654, 903, 50.2; 165/166

(56) References Cited

U.S. PATENT DOCUMENTS 4,130,160 A 12/1978 Dziedzk et al.
4,715,431 A * 12/1987 Schwarz et al. ..... 105/110
5,122,174 A * 6/1992 Sunder et al. ..... 62/654
5,904,205 A * 5/1999 Grenier et al. ..... 165/166

FOREIGN PATENT DOCUMENTS

WO WO 97 03281 A 1/1997

* cited by examiner

*Primary Examiner*—William C. Doerrler
(74) *Attorney, Agent, or Firm*—Williard Jones, II

(57) ABSTRACT

High pressure gaseous oxygen is obtained safely and without compression by heating pumped liquid oxygen in a printed circuit type heat exchanger having layers of transversely extending laterally spaced channels with each layer being in thermal contact with at least one other layer. Oxygen is vaporized in channels of oxygen-layers against heat exchange fluid passing through channels of heat exchange layers. The walls of the oxygen layer channels are formed of ferrous alloy and have a cross-section, in a plane perpendicular to the direction of flow, having a thickness at its narrowest of at least about 10%, and on average at least about 15%, of the combined hydraulic mean diameters of the adjacent channels, and the ratio of cross-sectional area, in said plane, of the walls to the cross-sectional area of the channels is no less than about 0.7.

25 Claims, 2 Drawing Sheets

APPARATUS AND METHOD OF HEATING PUMPED LIQUID OXYGEN

TECHNICAL FIELD OF THE INVENTION

The present Application relates to the heating of pumped liquid oxygen to safely provide high pressure gaseous oxygen without use of a gas compressor by use of a heat exchanger having specific geometry requirements for the oxygen flow channels and their associated walls and has particular, but not exclusive, application to the cryogenic separation of air to provide a high pressure gaseous oxygen product. It provides both a heat exchanger for heating high pressure liquid oxygen and a method of providing high pressure gaseous oxygen by indirect heat exchange against a heat exchange fluid such as air, nitrogen and the like.

BACKGROUND OF THE INVENTION

Some chemical processes such as partial oxidation of hydrocarbon fuels require large quantities of high pressure oxygen because it is often more economic to carry out the process at high pressure. Cryogenic air separation is the technology of choice for the supply of such oxygen and the oxygen obtained from such separation can be pressurized in two ways. Gaseous oxygen ("GOX") from the air separation unit ("ASU") can be compressed to the required pressure or a pumped liquid oxygen cycle can be employed in which liquid oxygen ("LOX") is pumped to the required pressure and heated to ambient temperature against a condensing boosted air or nitrogen stream. Sometimes the LOX is pumped to an intermediate pressure, vaporized against the boosted stream and then compressed to the required pressure.

There are several disadvantages associated with use of a high pressure gaseous oxygen compressor. Such compressors are expensive compared to air or nitrogen compressors and also tend to have lower aerodynamic efficiencies, as the machine clearances tend to be larger in order to minimize the possibility of a machine 'rub' and consequent fire caused by reaction of the compressor material with the oxygen. There is always a safety concern associated with the use of gaseous oxygen compressors, especially high pressure ones, due to the possibility of a compressor fire.

The above disadvantages make it preferable to use a pumped LOX cycle. There is a large body of patents and published literature concerning many aspects of pumped LOX cycles. Usually, the ASU heat exchangers are separated into two units; one using aluminum plate fin heat exchanger cores at low to medium pressure for the medium pressure air feed and returning nitrogen streams and a second aluminum high pressure plate fin heat exchanger for oxygen heating. However, it is known to combine all the duties in one aluminum high pressure plate fin heat exchanger.

An important consideration in the choice of aluminum plate fin heat exchangers is that, although reaction between LOX and aluminum can be explosive, it does require initiation by a primary energy release similar to the need for a booster explosion to detonate TNT. The reaction is much easier to initiate the higher the oxygen pressure and accordingly the pressure in aluminum heat exchangers is limited. However, the risk of an explosion if a primary energy release took place is not eliminated. Accordingly, when high pressure gaseous oxygen is required, it is current practice to limit the pressure of oxygen which is vaporized in an aluminum plate fin heat exchanger and to add an oxygen compressor to boost the resultant GOX to the required pressure. This adds equipment capital cost and compressing oxygen to high pressure also has safety implications in that oxygen compressor fires can occur.

It has been proposed to provide high pressure GOX by heating pumped LOX in a coil heat exchanger comprising copper, or copper based alloy, tube wound onto a central mandrel. Copper and copper based alloys such as cupronickel are ideal for this purpose because, in general, combustion cannot be initiated for copper below its melting point. However, the disadvantage of such copper wound coil heat exchangers is that they are very expensive and very large, as compared to a compact plate fin type heat exchanger.

A pumped LOX wound coil heat exchanger could be fabricated using stainless steel ("SS") or other cryogenically suitable ferrous alloy. It is known that SS will not explode when reacting with either liquid or gaseous pure oxygen, but instead simply burns. Thus a heat exchanger used in pumped LOX heating would be much safer when fabricated from SS rather than from aluminum, especially as the relatively thick walls of tubing provides thermal inventory to quench an energy release if one were to start. The article "Flammability Limits of Stainless Steel Alloys 304, 308, and 316" by Barry L. Werley and James G. Hansel (ASTM STP 1319; 1997) reports that thicker tube walls inhibit reaction between oxygen and SS. However, wound coil heat exchangers fabricated from SS are very expensive and very large, as compared to compact plate fin heat exchangers.

It is known that plate fin heat exchangers can be fabricated from SS. Such a heat exchanger could be used for high pressure pumped LOX heat exchanger service and would be safer than an aluminum heat exchanger. However, in current practice, a SS plate fin heat exchanger contains many very thin SS fins, usually having a thickness of less than about 10% of channel hydraulic mean diameter (the hydraulic mean diameter of a channel is calculated by dividing 4 times its cross-sectional area by its wetted perimeter), and the ratio of heat transfer surface area to SS weight is very high. Thus, in the event of a local reaction between oxygen and a thin SS fin, there would be little local metal thermal inventory to help quench the reaction and, accordingly, there would be more safety concerns related to the use of such heat exchangers for high pressure oxygen service than for the thicker walled SS wound coil heat exchangers.

Printed Circuit Heat Exchangers (PCHE) are a well known compact type of heat exchanger for use primarily in the hydrocarbon and chemical processing industries and have been commercially available since at least 1985. They are constructed from flat metal plates into which fluid flow channels are chemically etched or otherwise formed in a configuration suitable for the temperature and pressure-drop requirements of the relevant heat exchange duty. Conventionally, the metal is SS such as, for example, SS 316L; Duplex alloy such as, for example, Duplex alloy 2205 (UNS S31803); or commercially pure titanium. The channeled plates are stacked so that a plurality of spaced layers of passages are formed by closure of the channels in each plate by the base of a respective adjacent plate; the stacked plates are diffusion or otherwise bonded together to form heat exchange cores; and fluid headers or other fluid connections are welded or otherwise connected to the core in order to direct fluids to respective layers of the passages. In diffusion bonding, grain growth between metal parts is caused by pressing surfaces metal surfaces together at temperatures approaching the melting point to effect a solid-state type of weld. A fluid to be heated is passed through channels of some layers ("heating layers") and heated by indirect heat exchange against a warmer heat exchange fluid passing through channels of one or more intermediate layers ("cooling layers"). Usually, the plates from which the heating and cooling layers are formed have different channel designs.

Existing PCHE applications in hydrocarbon processing include, for example, hydrocarbon gas processing; PCHE applications in power and energy include, for example, feedwater heating and chemical heat pumps; and PCHE applications in refrigeration include chillers and condensers; cascade condensers and absorption cycles. It is reported that PCHEs can operate at temperatures from about −273° C. to about 800° C.

It is the primary object of this invention to provide a competitive method of supplying high pressure gaseous oxygen from an ASU without the use of an oxygen compressor and without incurring the risk of a reaction between oxygen and the heat exchanger material used in the oxygen heating process.

SUMMARY OF THE INVENTION

It has been found that the primary object of the invention can be achieved by use of a ferrous alloy heat exchanger having specific geometry requirements for the oxygen flow channels and their associated walls for high pressure pumped LOX heating service in which the passages in which LOX is heated have defined wall thickness criteria and defined criteria for the metal to oxygen volume ratio.

In particular, high pressure gaseous oxygen is obtained safely and without compression by heating pumped LOX in a heat exchanger having a body with a plurality of spaced layers of transversely extending laterally spaced channels with each layer being in thermal contact with at least one other layer. The LOX is vaporized in channels of at least one layer ("oxygen layer") against heat exchange fluid passing through channels of at least one layer ("heat exchange layer") adjacent an oxygen layer in thermal contact therewith. The walls defining the channels in the oxygen layer(s) are formed of stainless steel or other ferrous alloy suitable for use at cryogenic temperatures with the walls between adjacent channels in each oxygen layer and the walls between said channels in the oxygen layer and channels in an adjacent layer each having a cross-section, in a plane perpendicular to the direction of flow through the adjacent channels, having a thickness which at its narrowest is at least about 10% of the combined hydraulic mean diameters of the two adjacent channels and on average is at least about 15% of said combined hydraulic mean diameters, and the ratio of cross-sectional area, in said plane, of the mass of the ferrous alloy walls defining the channels in each oxygen layer to the cross-sectional area of the channels in that layer is no less than about 0.7, preferably at least about 0.8.

The relatively thick ferrous alloy walls associated with the oxygen stream minimize the possibility of a reaction and provide a heat sink in the event of a local energy release; and the high heat transfer coefficients, high heat transfer area per unit volume, and relatively low cost of ferrous alloy minimize the equipment capital cost.

DETAILED DESCRIPTION OF THE INVENTION

Figure 1:
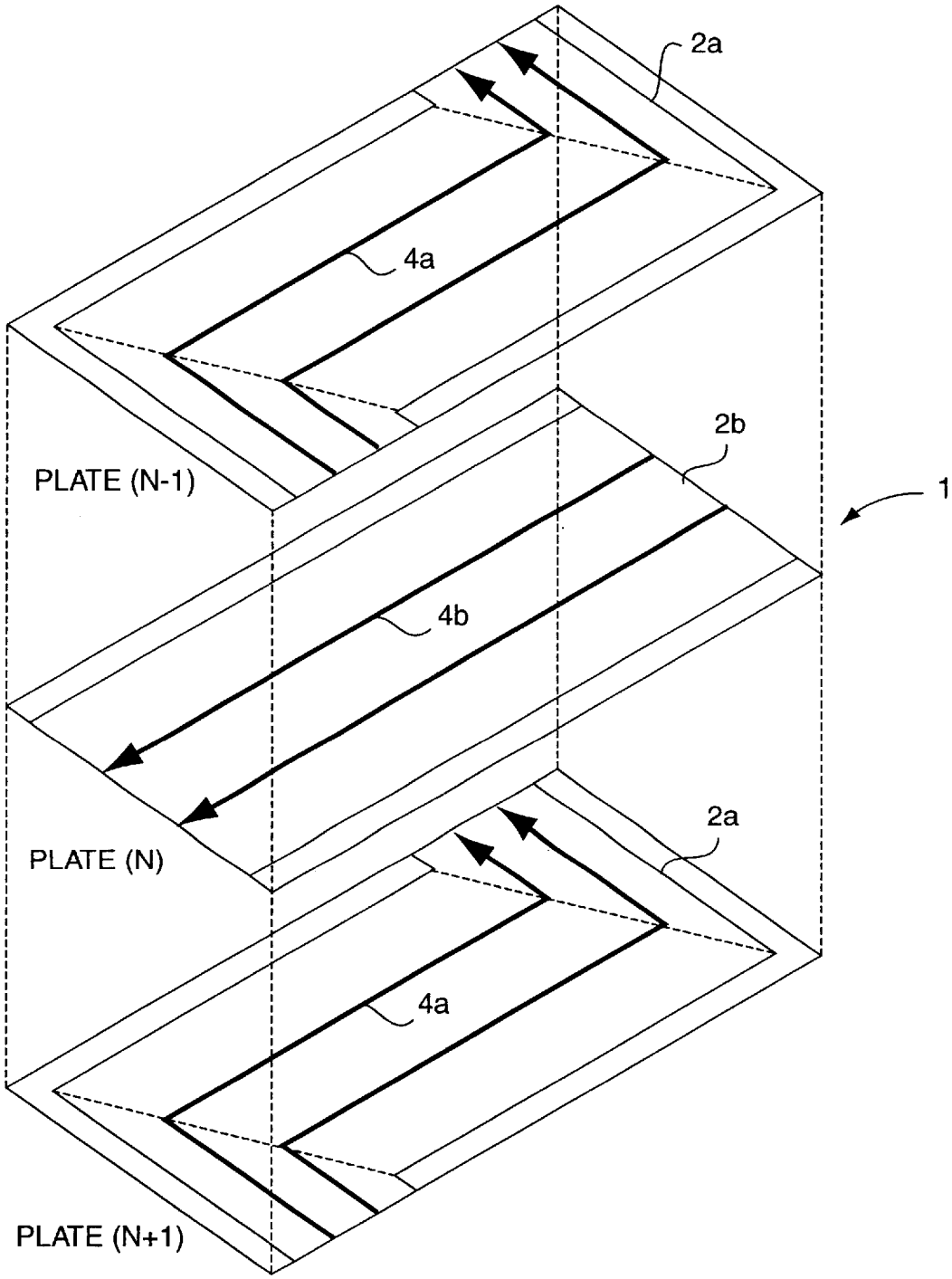
FIG. 1 is a schematic exploded drawing of a heat exchanger in accordance with a preferred embodiment of the present invention for heating pumped LOX from an ASU.

According to one aspect of the present invention, there is provided a heat exchanger for heating a stream of liquid oxygen at a pressure of at least about 30 bar (3 MPa) by indirect heat exchange against a heat exchange fluid, said heat exchanger comprising:

a body having a plurality of spaced layers of transversely extending laterally spaced channels defined by ferrous alloy walls with each layer being in thermal contact with at least one other layer;

oxygen inlet means for introducing pumped liquid oxygen at a pressure of at least about 30 bar (3 MPa) into the channels of at least one layer ("oxygen layer");

oxygen outlet means for removing heated oxygen from said channels of the oxygen layer(s);

heat exchange fluid inlet means for introducing heat exchange fluid into the channels of at least one layer ("heat exchange layer") adjacent an oxygen layer in thermal contact therewith;

heat exchange fluid outlet means for removing cooled heat exchange fluid from said channels of the heat exchange layer(s);

wherein the walls between adjacent channels in each oxygen layer and the walls between said channels in the oxygen layer and channels in an adjacent layer each have a cross-section, in a plane perpendicular to the direction of flow through the adjacent channels, having a thickness which at its narrowest is at least about 10% of the combined hydraulic mean diameters of the two adjacent channels and on average is at least about 15% of said combined hydraulic mean diameters, and the ratio of cross-sectional area, in said plane, of the mass of the ferrous alloy walls defining the channels in each oxygen layer to the cross-sectional area of the channels in that layer is no less than about 0.7, preferably at least about 0.8.

In a preferred embodiment of said aspect, the heat exchanger comprises:

a stack of ferrous alloy plates, each plate having a laterally spaced plurality of walls defining channels extending across the surface of the plate and each plate being in thermal contact with at least one other plate in the stack;

oxygen inlet means for introducing pumped liquid oxygen at a pressure of at least about 30 bar (3 MPa) into the channels of at least one plate ("oxygen plate");

oxygen outlet means for removing heated oxygen from said channels of the oxygen plate(s);

heat exchange fluid inlet means for introducing heat exchange fluid into the channels of at least one plate ("heat exchange plate") adjacent to an oxygen plate and in thermal contact therewith;

heat exchange fluid outlet means for removing cooled heat exchange fluid from said channels of the heat exchange plate(s);

wherein said walls between adjacent channels in each oxygen plate and the walls between said channels in the oxygen plate and channels in an adjacent plate each have a cross-section, in a plane perpendicular to the direction of flow through the adjacent channels, having a thickness which at its narrowest is at least about 10% of the combined hydraulic mean diameters of the two adjacent channels and on average is at least about 15% of said combined hydraulic mean diameters, and the ratio of cross-sectional area, in said plane, of the mass of each oxygen plate (including walls) to the cross-sectional area of the channels therein is at least about 0.7, preferably at least about 0.8.

According to a second aspect, the present invention provides a process for providing a stream of high pressure gaseous oxygen comprising introducing a pumped liquid oxygen stream at a pressure of at least about 30 bar (3 MPa) into channels of at least one layer ("oxygen layer") of a heat exchange body having a plurality of spaced layers of transversely extending laterally spaced channels defined by ferrous alloy walls with each layer being in thermal contact with at least one other layer and heating said oxygen stream during passage through said channels in the oxygen layer(s) by indirect heat exchange with a heat exchange fluid passing through channels of at least one layer ("heat exchange layer") adjacent an oxygen layer in thermal contact therewith; wherein the walls between adjacent channels in each oxygen layer and the walls between said channels in the oxygen layer and channels in an adjacent layer each have a cross-section, in a plane perpendicular to the direction of flow through the adjacent channels, having a thickness which at its narrowest is at least about 10% of the combined hydraulic mean diameters of the two adjacent channels and on average is at least about 15% of said combined hydraulic mean diameters, and the ratio of cross-sectional area, in said plane, of the mass of the ferrous alloy walls defining the channels in each oxygen layer to the cross-sectional area of the channels in that layer is no less than about 0.7, preferably at least about 0.8.

In a preferred embodiment of said second aspect, the process comprises introducing a pumped liquid oxygen stream at a pressure of at least about 30 bar (3 MPa) into channels of at least one plate ("oxygen plate") of a stack of ferrous alloy plates, each plate having a laterally spaced plurality of walls defining channels extending across the surface of the plate and each plate being in thermal contact with at least one other plate in the stack and heating said oxygen stream during passage through said channels in the oxygen plate(s) by indirect heat exchange with heat exchange fluid passing through channels of at least one plate ("heat exchange plate") adjacent an oxygen plate in thermal contact therewith;

wherein said walls between adjacent channels in each oxygen plate and the walls between said channels in the oxygen plate and channels in an adjacent plate each have a cross-section, in a plane perpendicular to the direction of flow through the adjacent channels, having a thickness which at its narrowest is at least about 10% of the combined hydraulic mean diameters of the two adjacent channels and on average is at least about 15% of said combined hydraulic mean diameters, and the ratio of cross-sectional area, in said plane, of the mass of each oxygen plate (including walls) to the cross-sectional area of the channels therein is no less than about 0.7, preferably at least about 0.8.

According to a third aspect, the invention provides a cryogenic process for the separation of air to provide a high pressure gaseous oxygen stream comprising separating a feed air stream in a distillation column system to provide at least a liquid oxygen stream and a gaseous nitrogen stream; pumping said liquid oxygen stream to a pressure of at least about 30 bar (3 MPa); and heating the pumped liquid oxygen by a process of said second aspect using, as the heat exchange fluid, air or a stream produced during the air separation. Usually, the cooled heat exchange fluid will be passed to the distillation column system.

Suitably, the pumped LOX to be vaporized in the invention is introduced at a pressure of at least about 60 bar (6 MPa). At least when the LOX is provided by an ASU, the heat exchange fluid usually will be part of the feed air or a nitrogen stream produced in the air separation. The LOX feed can be warmed to provide high pressure gaseous oxygen at any desired temperature but usually will be warmed to about ambient temperature.

The channels can be formed as in a conventional PCHE by chemically etching a plane precursor plate. Alternatively, they can be formed by, for example, machining a plane precursor plate; drilling a solid precursor core; or by brazing, welding or otherwise securing fins between plane base plates. When the heat exchanger is formed from a stack of plates, it is preferred that they are diffusion bonded in conventional PCHE manner.

Usually, the ferrous alloy used will be stainless steel, especially an austenitic stainless steel, particularly one containing about 16 to about 25% chromium, about 6 to about 16% nickel, at most about 0.15% carbon, and optionally also containing either or both molybdenum and titanium. Presently preferred austenitic stainless steels are AISI type 304 or AISI type 316.

Each oxygen layer or plate usually will be sandwiched between a respective pair of heat exchange layers or plates so that no oxygen layer or plate is adjacent another oxygen layer or plate. In this manner, the mass of ferrous alloy associated with each layer or plate, and the accompanying heat sink capacity, is significantly increased compared with an arrangement in which a pair of oxygen layers or plates are sandwiched between the same pair of heat exchange layers or plates. It is preferred that the oxygen and heat exchange layers or plates alternate; i.e. the oxygen and heat exchange layers or plates are interleaved.

All of the layers or plates can be substantially identical with each other except for end portions facilitating entry and exit of fluid in different directions for the oxygen and heat exchange fluid. Usually, at least the channels in the oxygen layer(s) or plate(s) have identical cross-section and are uniformly spaced. It is also preferred that the channels in the heat exchange layer(s) or plate(s) are aligned with respective channels in the adjacent oxygen layer(s) or plate(s).

The channels can be of any suitable cross-sectional shape and size but usually will be of arcuate, especially semicircular, or rectilinear, especially square or otherwise rectangular, cross-section or have a cross-section intermediate arcuate and rectilinear, and usually will have a hydraulic mean diameter less than about 3 mm. As explained previously, the hydraulic mean diameter is calculated in accordance with the equation: $d_h$=4Area/p, where $d_h$ is the hydraulic mean diameter, Area is the cross-sectional area of the channel and p is the length of the periphery of the channel. Thus in the case of a circular channel, the hydraulic mean diameter is the same as the actual diameter and in the case of a square channel, the hydraulic mean diameter is equal to the length of one side of the channel.

In the simplest configuration, the channels are straight in the flow direction. However, they can be of more complex shape to lengthen the flow path such as, for example, of herringbone, serpentine or zigzag shape in the flow direction. In particular, the channels can have an overall straight or serpentine configuration with a superimposed fine herringbone or zigzag pattern.

In some applications, provision is made for withdrawal of one or more portions of partially warmed oxygen and/or partially cooled heat exchange fluid from one or more intermediate locations of the heat exchanger, especially those in the heat exchange layer(s) or plate(s), and only a remaining portion of the oxygen and/or heat exchange fluid removed from the end of the heat exchanger. In such an arrangement, the heat exchanger conveniently is configured as two or more heat exchangers in series. When, the LOX is provided by an ASU, an intermediate temperature heat exchange fluid withdrawn in this manner can be expanded to provide refrigeration or cooled against a process stream in a separate heat exchanger.

A filter can be provided in the LOX path upstream of the heat exchanger to remove any debris from the LOX stream and thereby reduce the risk of blockage or particle collision in the channels of the oxygen layers or paths. Similarly, a filter can be provided in the heat exchange fluid path upstream of the heat exchanger to reduce the risk of debris blockage. Additionally or alternatively, the risk of energy release caused by particle collision can be reduced by limiting the velocity of flow through the channels in the oxygen layer(s) or plate(s) to, for example, about 10 m/sec at about 30 bar (3 MPa) to about 2.5 m/sec at about 100 bar (10 MPa).

When the pumped LOX is from an ASU, a second air or nitrogen-rich cooling stream can be provided. Typically this second cooling stream is withdrawn from the heat exchanger at an intermediate temperature in order to reduce the temperature difference between the warming and cooling streams and hence improve the thermal efficiency of the heat exchanger. The withdrawn stream can be expanded for refrigeration or further cooled in a separate heat exchanger. Typically the heat exchanger would be configured as two heat exchangers in parallel or, more usually, series to facilitate the withdrawal of the second cooling stream Referring to the Figures of the drawings, a PCHE-type heat exchanger has a core 1 formed of a stack of stainless steel plates 2*a* & 2*b*, of which only three (N−1, N & N+1) are shown, each having flow channels 3*a* & 3*b* (see FIG. 2) chemically etched into the upper surface thereof. In FIG. 1, the flow direction 4*a* & 4*b* is shown but not the flow channels 3. Suitably the plates are of AISI type 304 or AISI type 316 stainless steel. They are stacked so that a plurality of spaced layers of passages 5*a* & 5*b* are formed by closure of the channels 3*a* & 3*b* in each plate (e.g. N+1) by the base 6*a* & 6*b* of a respective adjacent plate (e.g. N) and secured together by diffusion bonding. Headers (not shown) are connected to the core 1 to pass oxygen through the passages 5*b* in every other ("oxygen") layer (e.g. N, N−2, N−4 etc.) and a heat exchange fluid through the passages 5*a* in the intervening ("heat exchange") layers (e.g. N−1, N+1, N+3 etc). As indicated in FIG. 1, the plates 2*a* & 2*b* can be identical except for the terminal portions of the channels 3*a* & 3*b*, which in the ("heat exchange") plates 2*a* (e.g. N−1 & N+1) providing the heat exchange passages 5*a* are angled to allow for location of the relevant headers at the side of the core 1, leaving the ends of the core 1 for location of the headers for the oxygen passages 2*b*.

Figure 2:
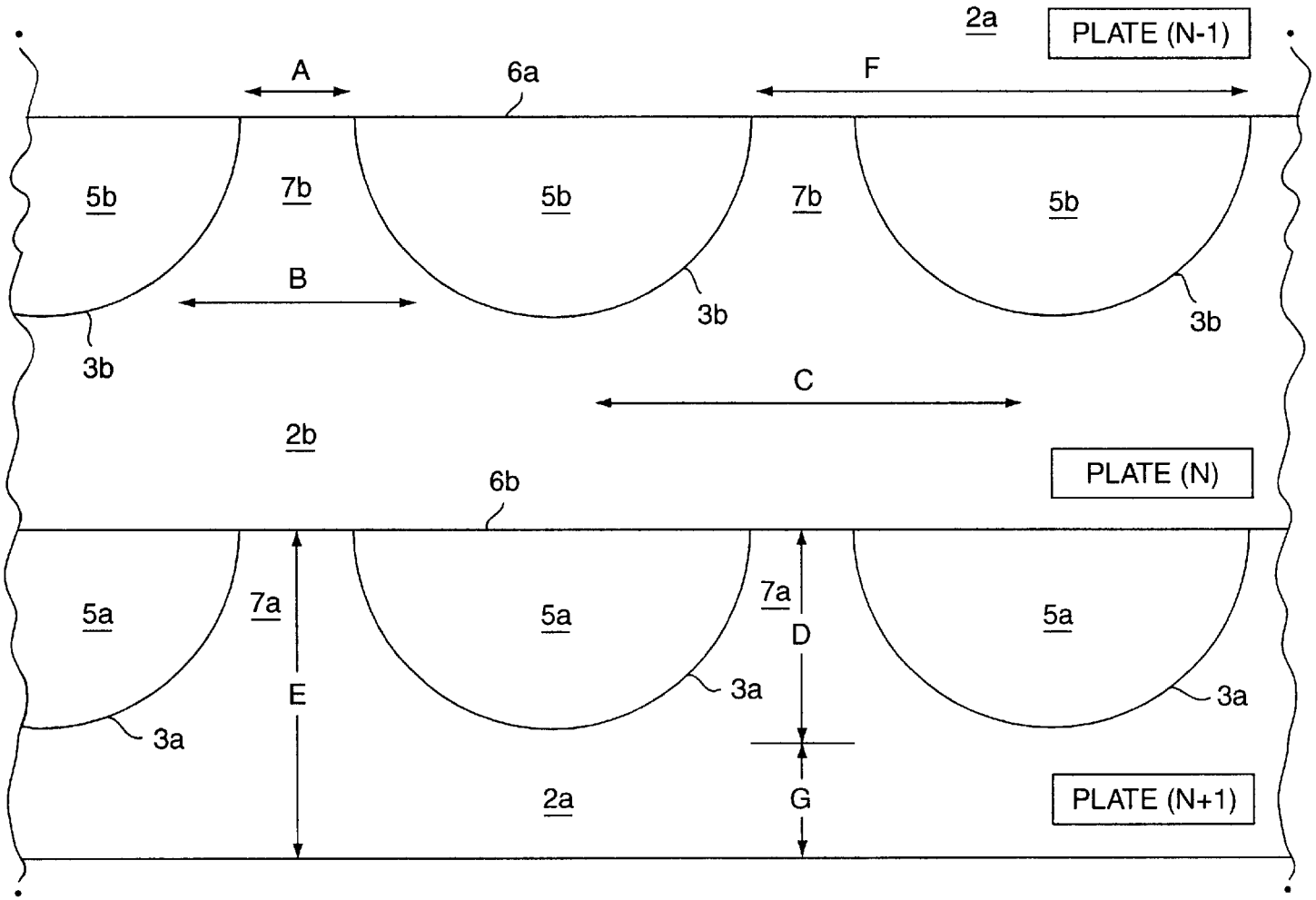
FIG. 2 is a schematic cross-section, in a plane perpendicular to fluid flow, of adjacent plates in the core of FIG. 1 in which the channels are of semicircular cross-section.

As shown in FIG. 2, the channels 3*a* & 3*b* in the exemplified embodiments are of semicircular cross-sectional shape and, when in the stack, provide passages 5*a* & 5*b* of corresponding cross-sectional shape. Typically, the channels have a hydraulic mean diameter of less than about 3 mm.

The walls 7*a* & 7*b* between adjacent channels have a minimum width A, an average width B, a maximum width C, and a height D, all dependent, in a manner described below, on the hydraulic mean diameter of the channels 3*a* & 3*b*. The wall average width B is the wall cross-sectional area divided by the wall height D. The total cross-sectional area of the plate 2*a* or 2*b* associated with one channel 3*a* or 3*b* is the plate height E multiplied by the channel pitch F. Subtracting the channel cross-sectional area from the total cross-sectional area gives the cross-sectional area of the mass of stainless steel associated with one channel.

The relationship between the walls 7 and the channels 3 is such that wall minimum width A is at least about 20% of the channel hydraulic mean diameter and wall average width B at least about 30% of the channel hydraulic mean diameter, and the ratio of cross-sectional area of the mass of each plate 2*a* or 2*b* to the cross-sectional area of the channels 3*a* or 3*b* in the plate is at least about 0.7 and preferably at least about 0.8. If adjacent channels 3*a* or 3*b* in the same plate were of different hydraulic mean diameters, the wall minimum width A and average width B would be respectively at least about 10% and at least about 15% of the combined hydraulic mean diameters of the two adjacent channels. Similarly, the thickness G of the wall below each channel also is at least about 20% of the channel hydraulic mean diameter and on average at least about 30% of the channel hydraulic mean diameter.

In use, pumped liquid oxygen from, for example, a cryogenic air separation unit (not shown) is feed to the passages 5*b* in the oxygen layers and during passage therethrough is vaporized by indirect heat exchange with, for example, a portion of the feed air to the unit, a nitrogen product stream from the unit, or a nitrogen-rich process stream withdrawn from the unit for return thereto. Since each oxygen plate 2*b* (e.g. N) is sandwiched between two heat exchange plates 2*a* (e.g. N−1 & N+1), the thermal inventory of the stainless steel of those plates 2*a* will also be available to quench any energy release in the oxygen plate 2*b*.

If the ratio of cross-sectional mass area to cross-sectional channel area is 0.8 and the total volume of channels 3*b* in each oxygen plate 2*b* is 1000 $cm^3$, there would be (1000 ×0.8×2=) 1600 $cm^3$ of stainless steel in each oxygen plate and adjacent heat exchange plate, which corresponds to approximately 224 gmol (12480 g) steel. If the oxygen is at 100 bar (10 MPa) and 200 K, it has a density of about 285 $kg/m^3$ and hence there would be about 8.9 gmol (285 g) of oxygen in the channels. If all of this oxygen inventory is completely converted to $Fe_2O_3$4 Fe+3 $O_2$=2 $Fe_2O_3$; heat of formation about 198500 cal/gmol), the amount of steel consumed (=(8.9×4)/3) would be about 11.9 gmol. Thus, after the reaction, the remaining steel (=224−11.9) would be about 212 gmol and the amount of oxide formed (=8.9×2)/3) would be about 5.93 gmol.

Assuming the specific heat to be 6.7 cal/K/gmol for the steel and 12 cal/K/gmol for the oxide and that all heat of reaction is used to heat up the steel and oxide, the temperature rise would be about 800 K, there by increasing the temperature (from about 200 K) to about 1000 K. In practice any energy release would initially commence at a single location and, by using a heat exchanger in accordance with the present invention, the high metal to oxygen ratio limits the temperature rise to a level where propagation of a local reaction to other oxygen channels throughout the heat exchanger is very unlikely.

Although the invention requires a relatively large ferrous alloy to gas volume ratio, the small channel size allows the heat exchanger to be designed with a large heat transfer surface area per unit volume. Also due to the small channel size and relatively thick walls, the heat exchanger can easily be designed for very high pressures. According to prior art teaching, the provision of high pressure oxygen from an ASU requires the use at least some high pressure gaseous oxygen compression or, for a fully pumped LOX cycle, an expensive copper- or ferrous alloy- wound coil heat exchanger for the product oxygen heating duties, or the risk of explosion by using an aluminum heat exchanger. The present invention allows a safe high pressure pumped LOX cycle to be employed without the use of expensive wound coil design for the oxygen heat exchanger. The average wall thickness to channel hydraulic mean diameter ratio in the heat exchanger of the present invention is much larger than that of generally available brazed ferrous alloy plate fin heat exchangers. This relatively massive ferrous alloy quantity provides a large heat sink to quench any energy release, if one were to occur. Thus such heat exchangers, when used in pumped LOX service, will be safer than brazed plate fin heat exchangers.

It will be understood by those skilled in the art that the invention is not restricted to the specific details of the embodiments described above and that numerous modifications and variation can be made without departing from the scope and equivalence of the following claims:

1. A heat exchanger for heating a stream of liquid oxygen at a pressure of at least about 30 bar by indirect heat exchange against a heat exchange fluid, said heat exchanger comprising:

a body having a plurality of spaced layers of transversely extending laterally spaced channels defined by ferrous alloy walls with each layer being in thermal contact with at least one other layer;

oxygen inlet means for introducing pumped liquid oxygen at a pressure of at least about 30 bar into the channels of at least one layer, hereafter "oxygen layers";

oxygen outlet means for removing heated oxygen from said channels of the oxygen layers;

heat exchange fluid inlet means for introducing heat exchange fluid into the channels of at least one layer, hereafter "heat exchange layers", adjacent to an oxygen layer and in thermal contact therewith;

heat exchange fluid outlet means for removing cooled heat exchange fluid from said channels of the heat exchange layers;

wherein the walls between adjacent channels in each oxygen layer and the walls between said channels in the oxygen layer and channels in an adjacent layer each have a cross-section, in a plane perpendicular to the direction of flow through the adjacent channels, having a thickness which at its narrowest is at least about 10% of the combined hydraulic mean diameters of the two adjacent channels and on average is at least about 15% of said combined hydraulic mean diameters, and the ratio of cross-sectional area, in said plane, of the mass of the ferrous alloy walls defining the channels in each oxygen layer to the cross-sectional area of the channels in that layer is no less than about 0.7.

2. A heat exchanger for heating a stream of liquid oxygen at a pressure of at least about 30 bar by indirect heat exchange against a heat exchange fluid, said heat exchanger comprising:

a stack of ferrous alloy plates, each plate having a laterally spaced plurality of walls defining channels extending across the surface of the plate and each plate being in thermal contact with at least one other plate in the stack;

oxygen inlet means for introducing pumped liquid oxygen at a pressure of at least about 30 bar into the channels of at least one plate, hereafter "oxygen plates";

oxygen outlet means for removing heated oxygen from said channels of the oxygen plates;

heat exchange fluid inlet means for introducing heat exchange fluid into the channels of at least one plate, hereafter "heat exchange plates", adjacent an oxygen plate in thermal contact therewith;

heat exchange fluid outlet means for removing cooled heat exchange fluid from said channels of the heat exchange plates;

wherein said walls between adjacent channels in each oxygen plate and the walls between said channels in the oxygen plate and channels in an adjacent plate each have a cross-section, in a plane perpendicular to the direction of flow through the adjacent channels, having a thickness which at its narrowest is at least about 10% of the combined hydraulic mean diameters of the two adjacent channels and on average is at least about 15% of said combined hydraulic mean diameters, and the ratio of cross-sectional area, in said plane, of the mass of each oxygen plate, including walls, to the cross-sectional area of the channels therein is at least about 0.7.

3. The heat exchanger according to claim 2, wherein the channels in at least the oxygen plates are chemically etched in a plane precursor plate.

4. The heat exchanger according to claim 2, wherein the channels in at least the oxygen plates are formed by machining a plane precursor plate.

5. The heat exchanger according claim 2, wherein the plates are diffusion bonded to form the stack.

6. The heat exchanger according to claim 2, wherein the channels in at least the oxygen plates are formed by the securing fins between plane base plates.

7. The heat exchanger according to claim 1, wherein said ratio of cross-sectional areas is at least about 0.8.

8. The heat exchanger according to claim 1, wherein said ferrous alloy is an austenitic stainless steel.

9. The heat exchanger according to claim 2, wherein each oxygen plate is sandwiched between a respective pair of heat exchange plates.

10. The heat exchanger according to claim 9, wherein said stack comprises alternate oxygen and heat exchange plates.

11. The heat exchanger according to claim 2, wherein all of said plates are substantially identical within the heat transfer sections.

12. The heat exchanger according to claim 2, wherein the channels in the oxygen plates have identical cross-sections and are uniformly spaced.

13. The heat exchanger according to claim 2, wherein the channels in the heat exchange plates are aligned with respective channels in the adjacent oxygen plates.

14. The heat exchanger according to claim 2, wherein the channels in the oxygen plate have a hydraulic mean diameter less than about 3 mm.

15. The heat exchanger according to claim 2, wherein the channels in the oxygen plates are straight in the flow direction.

16. The heat exchanger according to claim 2, wherein the channels in the oxygen plates are serpentine in the flow direction.

17. The heat exchanger according to claim 16, wherein the channels in the oxygen plates are locally of herringbone or zigzag shape.

18. The heat exchanger according to claim 2, including means for limiting the velocity of flow through the channels in the oxygen plates to reduce possible energy release caused by particle impingement.

19. A process for providing a stream of high pressure gaseous oxygen comprising introducing a pumped liquid oxygen stream at a pressure of at least about 30 bar into channels of at least one layer, hereafter "oxygen layers" of a heat exchange body having a plurality of spaced layers of transversely extending laterally spaced channels defined by ferrous alloy walls with each layer being in thermal contact with at least one other layer and heating said oxygen stream during passage through said channels in the oxygen layers by indirect heat exchange with a heat exchange fluid passing through channels of at least one layer, hereafter "heat exchange layers" adjacent an oxygen layer in thermal contact therewith;

wherein the walls between adjacent channels in each oxygen layer and the walls between said channels in the oxygen layer and channels in an adjacent layer each have a cross-section, in a plane perpendicular to the direction of flow through the adjacent channels, having a thickness which at its narrowest is at least about 10% of the combined hydraulic mean diameters of the two adjacent channels and on average is at least about 15% of said combined hydraulic mean diameters, and the ratio of cross-sectional area, in said plane, of the mass of the ferrous alloy walls defining the channels in each oxygen layer to the cross-sectional area of the channels in that layer is no less than about 0.7.

20. A process for providing a stream of high pressure gaseous oxygen comprising introducing a pumped liquid oxygen stream at a pressure of at least about 30 bar into channels of at least one plate, hereafter "oxygen plates", of a stack of ferrous alloy plates, each plate having a laterally spaced plurality of walls defining channels extending across the surface of the plate and each plate being in thermal contact with at least one other plate in the stack and heating said oxygen stream during passage through said channels in the oxygen plates by indirect heat exchange with heat exchange fluid passing through channels of at least one plate, hereafter "heat exchange plates", adjacent an oxygen plate in thermal contact therewith;

wherein said walls between adjacent channels in each oxygen plate and the walls between said channels in the oxygen plate and channels in an adjacent plate each have a cross-section, in a plane perpendicular to the direction of flow through the adjacent channels, having a thickness which at its narrowest is at least about 10% of the combined hydraulic mean diameters of the two adjacent channels and on average is at least about 15% of said combined hydraulic mean diameters, and the ratio of cross-sectional area, in said plane, of the mass of each oxygen plate, including walls, to the cross-sectional area of the channels therein is no less than about 0.7.

21. The process according to claim 20, wherein the liquid oxygen is introduced at a pressure of at least about 60 bar.

22. A cryogenic process for the separation of air to provide a high pressure gaseous oxygen stream comprising separating a feed air stream in a distillation column system to provide at least a liquid oxygen stream and a gaseous nitrogen stream; pumping said liquid oxygen stream to a pressure of at least about 30 bar; and heating the pumped liquid oxygen by introducing it into channels of at least one layer, hereafter "oxygen layers", of a heat exchange body having a plurality of spaced layers of transversely extending laterally spaced channels defined by ferrous alloy walls with each layer being in thermal contact with at least one other layer and heating said oxygen stream during passage through said channels in the oxygen layers by indirect heat exchange with a heat exchange fluid, selected from air and a stream produced during the air separation, passing through channels of at least one layer, hereafter "heat exchange layers" adjacent an oxygen layer in thermal contact therewith;

wherein the walls between adjacent channels in each oxygen layer and the walls between said channels in the oxygen layer and channels in an adjacent layer each have a cross-section, in a plane perpendicular to the direction of flow through the adjacent channels, having a thickness which at its narrowest is at least about 10% of the combined hydraulic mean diameters of the two adjacent channels and on average is at least about 15% of said combined hydraulic mean diameters, and the ratio of cross-sectional area, in said plane, of the mass of the ferrous alloy walls defining the channels in each oxygen layer to the cross-sectional area of the channels in that layer is no less than about 0.7.

23. A cryogenic process for the separation of air to provide a high pressure gaseous oxygen stream comprising separating a feed air stream in a distillation column system to provide at least a liquid oxygen stream and a gaseous nitrogen stream; pumping said liquid oxygen stream to a pressure of at least about 30 bar; and heating the pumped liquid oxygen by introducing it into channels of at least one plate, hereafter "oxygen plates", of a stack of ferrous alloy plates, each plate having a laterally spaced plurality of walls defining channels extending across the surface of the plate and each plate being in thermal contact with at least one other plate in the stack and heating said oxygen stream during passage through said channels in the oxygen plates by indirect heat exchange with heat exchange fluid passing through channels of at least one plate, hereafter "heat exchange plates" adjacent an oxygen plate in thermal contact therewith;

wherein said walls between adjacent channels in each oxygen plate and the walls between said channels in the oxygen plate and channels in an adjacent plate each have a cross-section, in a plane perpendicular to the direction of flow through the adjacent channels, having a thickness which at its narrowest is at least about 10% of the combined hydraulic mean diameters of the two adjacent channels and on average is at least about 15% of said combined hydraulic mean diameters, and the ratio of cross-sectional area, in said plane, of the mass of each oxygen plate, including walls, to the cross-sectional area of the channels therein is no less than about 0.7.

24. The cryogenic air separation process according to claim 23, wherein the pumped liquid oxygen flowing through said channels in said oxygen plates is initially heated by a first heat exchange fluid containing at least one air component flowing through a first set of said channels in the heat exchange plates and then further heated by a second heat exchange fluid flowing through a second set of said channels in the heat exchange plates at a pressure higher the first heat exchange fluid.

25. The cryogenic air separation process according to claim 23, wherein the pumped liquid oxygen flowing through said channels in said oxygen plates is initially heated by a first heat exchange fluid containing at least one air component flowing in plates adjacent to the oxygen plates and then further heated by a second heat exchange fluid also containing at least one air component flowing in plates adjacent to the oxygen plates.

* * * * *